United States Patent [19]

Brill et al.

[11] 4,137,954

[45] Feb. 6, 1979

[54] LIQUIDS CONTAINERS

[75] Inventors: Karl H. Brill, Oftersheim; Gerhard Schenk, Brühl-Rohrhof; Rudolf Weinlich, Monsheim, all of Fed. Rep. of Germany

[73] Assignee: Enzinger-Union-Werke AG, Mannheim, Fed. Rep. of Germany

[21] Appl. No.: 829,175

[22] Filed: Aug. 30, 1977

[30] Foreign Application Priority Data

Sep. 4, 1976 [DE] Fed. Rep. of Germany ..... 2639918
Oct. 13, 1976 [DE] Fed. Rep. of Germany ..... 2646092

[51] Int. Cl.[2] ..... B65B 3/18; B67C 7/00

[52] U.S. Cl. ..... 141/90; 141/302; 137/864; 137/871

[58] Field of Search ..... 141/1-12, 141/65, 39-64, 66, 250, 285, 291-302, 374, 98, 392, 89, 90, 91, 92; 137/864, 871

[56] References Cited

U.S. PATENT DOCUMENTS 3,834,118 9/1974 Waldrop et al. ..... 141/65

*Primary Examiner*—Houston S. Bell
*Attorney, Agent, or Firm*—Sughrue, Rothwell, Mion, Zinn and Macpeak

[57] ABSTRACT

There is disclosed a liquids container provided with duct means for conducting fluids into and out of the container, the container comprising head and base portions and side walls connecting the head and base portions, and the duct means being secured to and extending into the container from the head portion. The duct means comprises three concentric pipes, the outermost one of which opens into the container near its head portion and the other two of which open into the container near its base portion, with the innermost one of the latter two pipes opening out at a greater distance from the container head portion than the other one of the two pipes. The duct means also comprises valve means normally closing the conduits and operable to open the conduits. There is further disclosed drawoff, cleaning and filling heads which can be connected to the container duct means and can be used to open different combinations of the conduits to enable fluids to be supplied to and removed from the container.

13 Claims, 3 Drawing Figures

LIQUIDS CONTAINERS

BACKGROUND OF THE INVENTION

The present invention relates to a liquids container provided with duct means for the ingress of fluids into and egress of fluids from the container, and to drawoff, cleaning and filling heads associated with the container.

In a known container provided with duct means (Enzinger-Nachrichten No. 3, 1974, pages 211 to 214), two conduits are provided appropriate to use for beer, wherein, for example during drawing-off, an inner one of the conduits is connected with a tap cock and the outer one of the conduits with a source of pressure gas.

In the case of drinks which tend to separate out in storage, for example fruit juice drinks, such a duct means has the disadvantage that the drink is inhomogeneously drawn off.

For alcohol-free drinks which similarly tend to separate out, there is disclosed in German (Federal Republic) Utility Models Nos. 66 08 908 and 72 09 306 a container, which, at a head part thereof, has three spaced-apart self-closing conduits, one of which is arranged centrally with respect to the others and is associated with a detachable oval lid. This centrally arranged conduit opens out in a head region of the interior of the container, while the other two conduits, which are disposed opposite to one another at the circumference of the head part of the container, open out through respective pipes in a base region of the container, the pipes being bent towards one another at their lower ends.

During drawing-off of liquid from the container, the centrally arranged duct, which serves for ventilation during filling, is closed. A pressure gas, for example $CO_2$, is fed through one of the pipes, while the other pipe serves for the drawing-off. The pressure gas bubbles from the base region through the drink up into the head region and thereby effects intermixing of the drink.

The duct means of this known container does not permit fully automatic cleaning and filling of the container. Rather, the detachable lid must be taken off by hand for cleaning and plugged into separate cleaning equipment of the cleaning machine, and the container must be turned and be placed with its lid opening on a cleaning jet head.

On subsequent closure of the container by hand, there exists the danger of contamination of the interior of the container. In addition, the duct means and the detachable lid, inclusive of its closure mechanism, are vulnerable to damage, the conduit pipes being arranged without support from each other and the detachable lid being of light construction.

SUMMARY OF THE INVENTION

According to the present invention there is provided a liquids container provided with duct means for the ingress of fluids into and egress of fluids from the container, the container comprising a head portion, a base portion, and side walls connecting said head and base portions, and the duct means being secured to and extending inwardly of the container from said head portion and comprising a first pipe defining a first conduit communicating with the interior of the container in the region of said head portion, a second pipe arranged concentrically inwardly of the first pipe and defining a second conduit communicating with the interior of the container in the region of said base portion, a third pipe arranged concentrically inwardly of the second pipe and defining a third conduit communicating with the interior of the container in the region of said base portion, the third conduit communicating with the interior of the container at a greater distance from said head portion than the second conduit, and respective valve means associated with the each of pipes to close the conduits, the valve means being operable to open the conduits thereby to permit the ingress of fluids into and egress of fluids from the container through the conduits.

In the case of a container provided with duct means as described above, fully automatic cleaning, filling and conveying can be carried out, which allows particularly economical modes of operation with appreciable saving of personnel. In addition, the danger of ingress of bacteria, foreign bodies and dirt particles into the container is effectively avoided, and a humid atmosphere can be maintained in the empty container so as to prevent drying-on of drinks residues. The duct means forms a robust assembly, which is particularly suitable for automatic connection to treatment heads and has minimum liability to damage.

During the drawing-off of liquids from a container embodying the invention said valve means are operated to open the second and third conduits and a pressure gas is supplied through the second conduit to the interior of the container thereby to cause liquid in the container to be expelled through the third conduit.

In addition, the valve means may be operated to open the first conduit to conduct away pressure gas supplied in excess of that required for the drawing-off, such excess gas providing a particularly intensive intermixing of the liquid in the container.

To enable the aforesaid drawing-off of liquid to be carried out, there may be provided in combination with such container a drawoff head, which is detachably connected to said duct means and which comprises means defining a gas inlet conduit and a liquid outlet conduit communicable with, respectively, the second conduit and the third conduit of said duct means, and valve-operating means actuable to operate said valve means of said duct means to open the second and third conduits.

During the cleaning of a container embodying the invention, said head portion of the container is positioned lowermost, said valve means are operated to open the first, second and third conduits, at least one cleansing substance is supplied through the second and third conduits to the interior of the container, and the or each cleansing substance and entrained residues are drained from the container through the first conduit. Advantageously, compressed air, cold water, lye, hot water or steam are selectably supplied through the second and third conduits.

To enable the afore said cleaning to be carried out, there may be provided in combination with such container a cleaning head, which is detachably connected to said duct means and which comprises means defining two cleansing fluid inlet conduits communicable with, respectively, the second and third conduits of said duct means and a fluid cleansing outlet conduit communicable with the first conduit of said duct means, and valve-operating means actuable to operate said valve means of said duct means to open the first, second and third conduits.

By means of this cleaning head, the container as well as the duct means can be rapidly and reliably cleaned in a fully automatic process.

Preferably, the cleaning head comprises a body portion detachably secured to said head portion of the container said valve-operating means being slidably engaged in said body portion and actuable to operate said valve means.

During the filling of a container embodying the invention, said head portion of the container is positioned lowermost, said valve means are operated to open only the first and third conduits, liquid is supplied to the interior of the container through the first conduit and a pressure gas is supplied to or a pressure gas is exhausted from the container through the third conduit. To enable the aforesaid filling to be carried out, there may be provided in combination with such container a filling head, which is detachably connected to said duct means and comprises valve-operating means actuable to operate said valve means of said duct means to open the first and third conduits of said duct means, means defining a liquid inlet conduit communicable with the first conduit of said duct means to supply liquid to the interior of the container through the first conduit, and means defining a gas inlet or a gas outlet conduit communicable with the third conduit of said duct means to supply a pressure gas to or to exhaust a pressure gas from the container through the third conduit.

BRIEF DESCRIPTION OF THE DRAWINGS

An embodiment of the present invention will now be more particularly described by way of example with reference to the accompanying drawings, in which.

DESCRIPTION OF THE PREFERRED EMBODIMENT

Figure 1:
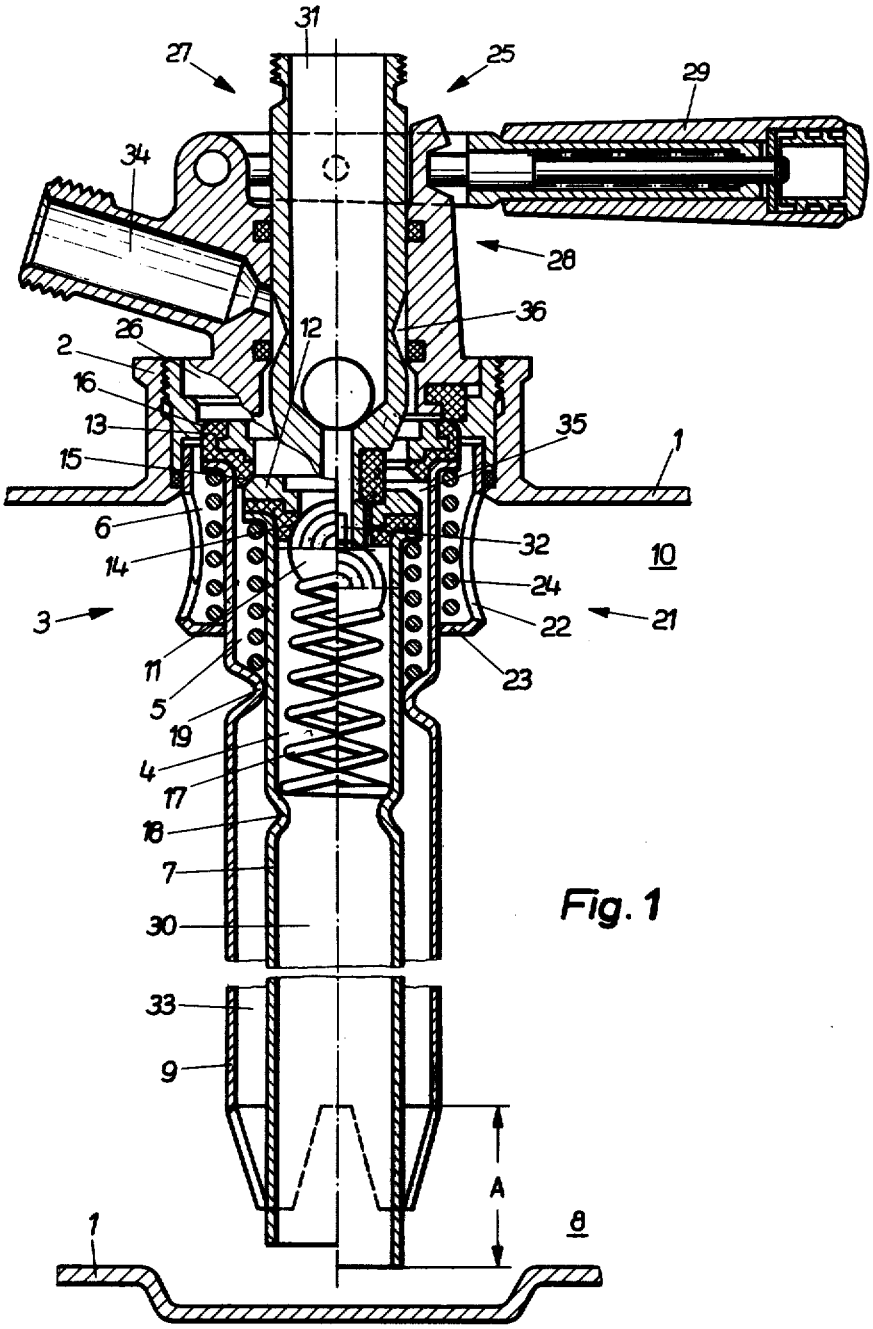
FIG. 1 is a schematic sectional elevation of part of a container embodying the invention, the container being provided with duct means and fitted with a drawoff head actuating, in the righthand half of the figure, valve means of the duct means to permit drawing-off of liquid from the container.

Referring now to FIG. 1 of the drawings, there is shown part of a container 1 for liquids, in particular for drinks such as fruit juice which tend to separate out in storage, the container comprising a head portion with a threaded connection stub pipe 2, a base portion with an interior recess, and side walls (not shown) connecting the head and base portions.

Secured to and extending inwardly of the container 1 from the head portion thereof is a duct means 3, which essentially comprises a connection ring threadedly engaged in the connection stub pipe 2, a short outer pipe 21 attached to the connection ring and defining an outer conduit 6 communicating, by way of apertures 22 in the pipe 21, with a region 10 of the interior of the container adjacent said head portion, an intermediate vortex pipe 10 arranged concentrically inwardly of the outer pipe 21 and defining an intermediate conduit 5 communicating, by way of apertures provided in the free end portion of the pipe 9, with a region 8 of the interior of the container adjacent said base portion, and an inner pipe 7 arranged concentrically inwardly of the intermediate pipe 9 and defining an inner conduit 4 also communicating with the region 8 of the container interior, but at a spacing below the uppermost edges of said apertures in the free end portion of the pipe 9. The intermediate pipe 9 is guided by means of an annular flange 23 of the outer pipe 21 to be displaceable in longitudinal direction relative to the pipe 21, and the inner pipe 7 is guided, by means of inwardly angled projections at the free end portion of the pipe 9 and a plurality of spaced apart inwardly directed circumferential corrugations 19 (only one of which is shown) in the wall 33 of the pipe 9, to be similarly displaceable in longitudinal direction relative to the pipes 9 and 21.

The duct means 3 further comprises valve means associated with the pipes to close the conduits and operable to open the conduits thereby to permit the ingress of fluids into and egress of fluids from the container through the conduits, the valve means comprising a respective valve associated with each pipe and independently operable so that different combinations of the conduits can be opened for different purposes, such as filling, cleaning and drawing-off from the container. The valve associated with the outer pipe 21 and controlling the outer conduit 6 comprises a valve seat 16 provided on the connection ring of the duct means, a valve body 13 arranged on the intermediate pipe 9 to be displaceable therewith and cooperable with the valve seat 16, and a spring 24 bearing on the flange 23 of the pipe 21 and urging the valve body 13 into engagement with the valve seat 16 thereby to close the conduit 6. The valve associated with the intermediate pipe 9 and controlling the intermediate conduit 5 comprises a valve seat 15 provided on the pipe 9, a valve body 12 arranged on the inner pipe 7 to be displaceable therewith and co-operable with the valve seat 15, and a spring 20 bearing on the uppermost one of the corrugations 19 in the wall of the pipe 9 and urging the valve body 12 into engagement with the valve seat 12 thereby to close the conduit 5. Finally, the valve associated with the inner pipe 7 and controlling the inner conduit 4 comprises a valve seat 14 provided on the pipe 7, a ball 11 arranged in the pipe 7 to be displaceable therein and co-operable with the valve seat 14, and a spring 17 bearing on the uppermost one of a plurality of spaced apart, inwardly directed circumferential corrugations 18 (only one of which is shown) in the wall 30 of the pipe 7 and urging the ball 11 into engagement with the valve seat 14 thereby to close the conduit 4. Thus, by displacing the valve body 13, together with the pipe 9, against the bias of the spring 24 and relative to the valve seat 16, the conduit 6 can be opened, and by displacing the valve body 12, together with the pipe 7, against the bias of the spring 20 and relative to the valve seat 15, the conduit 5 can be opened. Similarly, the conduit 4 can be opened by displacing the ball 11 against the bias of the spring 17 and relative to its valve seat 14.

To enable a liquid to be drawn-off from the container 1, a drawoff head 25 is detachably secured to the duct means 3, with the head portion of the container uppermost. The drawoff head 25 comprises a body portion 28 secured, for example by means of a bayonet closure, in a cylindrical recess 26 in the connection ring of the duct means, a valve-operating member 27 slidably engaged in a bore in the body portion 28, and a lever 29 pivotably mounted on the body portion 28 and operable to displace the member 27 in the bore of the body portion. The member 27 is adapted at its lower end to so engage the valve body 12 and ball 11 that on displacement of the member downwardly in the bore of the body portion 28, initially the ball 11 is lifted off its valve seat 14 and subsequently the valve body 12 is lifted off its valve seat 15, as shown in the righthand half of FIG. 1, thereby to open the conduits 4 and 5. Thereagainst, the valve body remains urged against its valve seat 16, and the consequent displacement of the pipe 7 relative to the pipe 9 produces a certain spacing A between the end of the pipe 7 and the uppermost edges of the apertures in the free end portion of the pipe 9.

The drawoff head 25 is provided with a liquid outlet conduit, which communicates with the inner conduit 4 when opened by the respective valve and which is defined by an axial bore 31 in the valve-operating member 27 and a plurality of apertures 32 in the wall of the bore. Retained in the axial bore of the member 27 is a ball co-operable with a step in the bore to provide a one-way valve closure. The drawoff head 25 is also provided with a fluid inlet conduit, which communicates with the intermediate conduit 5 when opened by the respective valve and which is defined by a bore 34 in the body portion 28 and an annular passage 36 between the body portion and the member 27, the communication being effected by way of an annular passage 35 formed between the valve seat 15 and the valve body 12 when displaced relative thereto.

To draw-off liquid from the container 1, the valve-operating member is displaced downwardly to open the conduits 4 and 5 to, respectively, the liquid outlet conduit and fluid inlet conduit of the drawoff head 25, and a pressure gas, for example $CO_2$, is fed through the fluid inlet conduit and conduit 5 to the region 8 of the interior of the container, from where it bubbles upwardly into the region 10 and effects the desired homogenisation of the liquid in the container. The feed of pressure gas into the container results in expulsion of the liquid through the conduit 4 and liquid outlet conduit. By virtue of the spacing A, it is ensured that the pressure gas does not directly escape into the conduit 4.

If so desired, the drawoff head can be adapted to displace the valve body 13 so as to open the conduit 6 and can be provided with a fluid outlet conduit which communicates with the conduit 6 when open and which serves as an outlet for excess pressure gas when the gas is supplied in excess of the required amount for drawing-off so as to intensify the mixing of the liquid content of the container.

Figure 2:
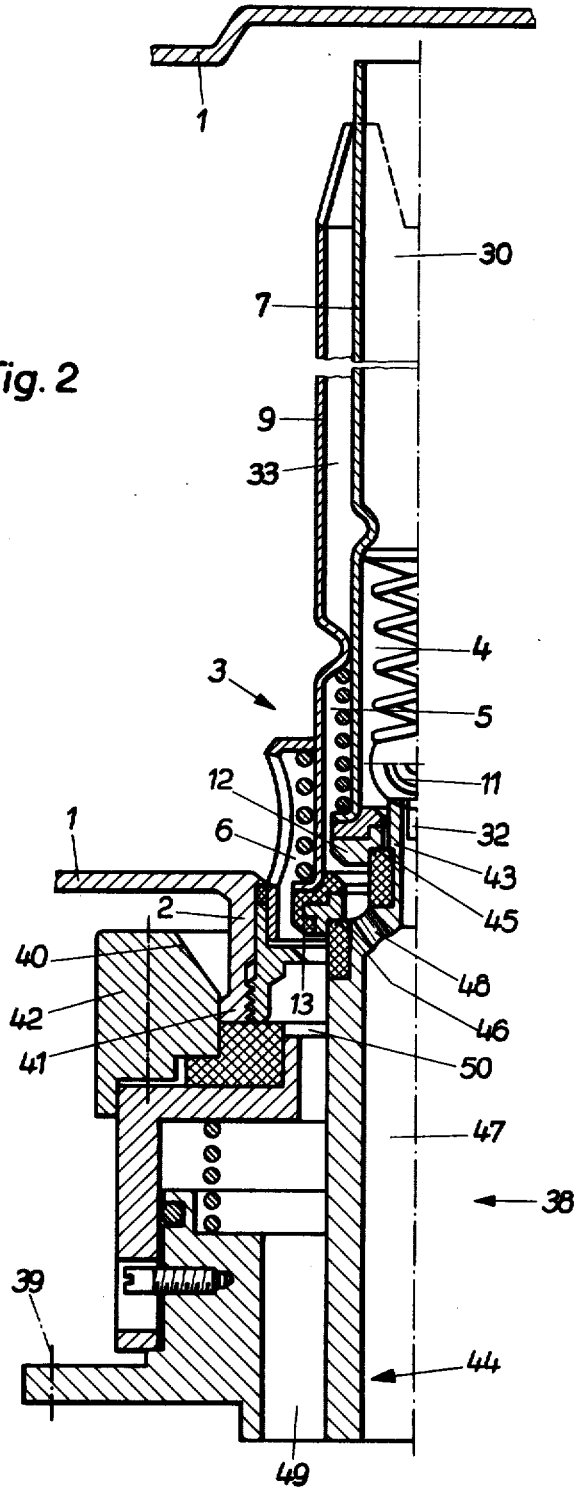
FIG. 2 is a schematic sectional elevation of one half of the container part and duct means shown in FIG. 1, fitted with a cleaning head actuating the valve means of the duct means to permit cleaning of the container.

To enable cleaning of the container 1 and the duct means 3, the drawoff head 25 is removed and the container is inverted and mounted on a cleaning head 38, as shown in FIG. 2, of a cleaning machine (not shown). The cleaning head 38 comprises a first body portion secured to the cleaning machine by screw connections 39, a second body portion mounted on the first body portion to be displaceable relative thereto and urged by a spring in a direction away from the machine side of the cleaning head 38, and a central valve-operating member 44, which is mounted to be stationary relative to the first body portion and which projects through an axial bore 49 in that body portion and an axial bore 50 in the second body portion. The second body portion is provided with a guide member 42 defining a cylindrical space 41 for receiving the connection stub pipe 2 of the container, the guide member having a frusto-conical guide surface 40 for guidance of the stub pipe 2 into the space 41.

The valve-operating member 44 is provided with a tubular end portion 43 and shoulders 45 and 46 so engageable with, respectively, the ball 11 and valve bodies 12 and 13 that on movement of the container towards the stationary member 44, the ball 11 and valve bodies 12 and 13 are successively displaced relative to their respective valve seats to open the conduits 4, 5 and 6.

In addition, the cleaning head 38 is provided with fluid inlet conduits, which communicate with the conduits 4 and 5 when opened and which are defined by an axial bore 47 in the member 44, apertures 32 arranged to communicate with the conduit 4 and bores 48 arranged to communicate with the conduit 5, and with a fluid outlet conduit, which communicates with the conduit 6 when opened and which is essentially constituted by the bores 49 and 50 in the first and second body portions.

To clean the container 1 and the duct means 3, the inverted container is automatically engaged with the cleaning head 38 by transport means (not shown), with the stub pipe of the container being inserted into the cylindrical space 41 defined by the guide member 42. The container together with the guide member 42 and second body portion is moved downwardly against the spring bias by a pressing device (not shown) acting on the container from above, the downward movement of the container causing the stationary valve-operating member 44 to successively displace the ball 11 and valve bodies 12 and 13 thereby to open the conduits 4 and 5 to the fluid inlet conduits of the cleaning head and the conduit 6 to the fluid outlet conduit of the cleaning head.

A cleansing fluid is then fed through the fluid inlet conduits and the conduits 4 and 5 to the interior of the container and is conducted away through the conduit 6 and fluid outlet conduit. At a higher pressure, the cleansing fluid acts primarily on the interior surfaces of the container, while at a lower pressure the fluid acts primarily on the surfaces of the duct means 3. Compressed air, cold water, lye, hot water or steam can be selectably supplied through the fluid inlet conduit and conduits 4 and 5 to effect cleaning of the container, and the conduit 6 and fluid outlet conduit can also serve for the draining of residues from the container.

To enable filling of the container, with the container inverted as in the case of the cleaning treatment, a filling head, constructed substantially in correspondence with the cleaning head 38, can be detachably connected to the duct means 3 of the container. The filling head can be provided with means to displace the ball 11 and valve body 13 thereby to open only the inner conduit 4 and outer conduit 6, and liquid can be charged through the conduit 6 with pressurising gas being supplied or conducted away through the conduit 4.

It will be readily apparent that numerous other modifications and embodiments can be devised by those skilled in the art and within the true spirit and scope of the present invention.

We claim:

1. A liquids container provided with duct means for the ingress of fluids into and egress of fluids from the container, the container comprising a head portion, a base portion, and side walls connecting said head and base portions, and the duct means being secured to and extending inwardly of the container from said head portion and comprising a first pipe defining a first conduit communicating with the interior of the container in the region of said head portion, a second pipe arranged concentrically inwardly of the first pipe and defining a second conduit communicating with the interior of the container in the region of said base portion, a third pipe arranged concentrically inwardly of the second pipe and defining a third conduit communicating with the interior of the container in the region of said base portion, the third conduit communicating with the interior of the container at a greater distance from said head portion than the second conduit, and respective valve means associated with each of the pipes to close the conduits, the valve means being operable to open the conduits thereby to permit the ingress of fluids into and egress of fluids from the container through the conduits.

2. A container as defined in claim 1, wherein the valve means comprises a respective valve associated with each of the pipes and independently operable to open the respective conduit.

3. A container as defined in claim 2, wherein the valve associated with the first pipe comprises a valve seat mounted to be stationary relative to the first pipe and a valve body carried by the second pipe, the second pipe being slidably engaged in the first pipe and the valve body being resiliently urged into engagement with the valve seat.

4. A container as defined in claim 2, wherein the valve associated with the second pipe comprises a valve seat carried by the second pipe and a valve body carried by the third pipe, the third pipe being slidably engaged in the second pipe and the valve body being resiliently urged into engagement with the valve seat.

5. A container as defined in claim 2, wherein the valve associated with the third pipe comprises a valve seat carried by the third pipe and a valve body arranged in the third pipe, the valve body being resiliently urged into engagement with the valve seat.

6. A container as defined in claim 1 in combination with a drawoff to draw off liquid from the container, the drawoff head being detachably connected to said duct means and comprising means defining a gas inlet conduit and a liquid outlet conduit communicable with, respectively, the second conduit and the third conduit of said duct means, and valve-operating means actuable to operate said valve means of said duct means to open the second and third conduits.

7. A combination as defined in claim 6, wherein the drawoff head further comprises means defining a gas outlet conduit communicable with the first conduit of said duct means, said valve-operating means being actuable to operate said valve means to additionally open the first conduit.

8. A combination as defined in claim 6 wherein the draw-off head comprises a body portion detachably secured to the first pipe of the said duct means, said valve-operating means being slidably engaged in said body portion and actuable to operate said valve means.

9. A combination as defined in claim 7, wherein said gas inlet conduit is provided by a bore in said portion and an annular passage between said body portion and said valve-operating means, and said liquid outlet conduit is provided by a bore in said valve-operating means.

10. A container as defined in claim 1 in combination with a cleaning head to clean the container, the cleaning head being detachably connected to said duct means and comprising means defining two cleansing fluid inlet conduits communicable with, respectively, the second and third conduits of said duct means and a cleansing fluid outlet conduit communicable with the first conduit of said duct means, and valve-operating means actuable to operate said valve means of said duct means to open the first, second and third conduits.

11. A combination as defined in claim 9, wherein the cleaning head comprises a body portion detachably secured to said head portion of the container, said valve-operating means being slidably engaged in said body portion and actuable to operate said valve means.

12. A combination as defined in claim 10 wherein said fluid inlet conduits are provided by a bore in said valve-operating means, with a first plurality of outlets communicable with the second conduit and a second plurality of outlets communicable with the third conduit, and said fluid outlet conduit is provided by an annular passage between said body portion and said valve-operating means.

13. A container as defined in claim 1 in combination with a filling head to fill the container with liquid, the filling head being detachably connected to said duct means and comprising valve-operating means actuable to operate said valve means of said duct means to open the first and third conduits of said duct means, means defining a liquid inlet conduit communicable with the first conduit of said duct means to supply liquid to the interior of the container through the first conduit, and means defining a gas inlet or a gas outlet conduit communicable with the third conduit of said duct means to supply a pressure gas to exhaust a pressure gas from the container through the third conduit.

* * * * *